United States Patent [19]

Marzoli

[11] 4,150,531

[45] Apr. 24, 1979

[54] SPINNING AND TWISTING MECHANISM

[75] Inventor: Angelo Marzoli, Palazzolo Sull'oglio, Italy

[73] Assignee: The Upjohn Company, Kalamazoo, Mich.

[21] Appl. No.: 893,117

[22] Filed: Apr. 4, 1978

[30] Foreign Application Priority Data

Apr. 13, 1977 [IT] Italy ..... 22430 A/77

[51] Int. Cl.[2] ..... D01H 7/56

[52] U.S. Cl. ..... 57/124; 57/122

[58] Field of Search ..... 57/119–124

[56] References Cited

U.S. PATENT DOCUMENTS

| | | | |
|---|---|---|---|
| 795,814 | 8/1905 | Buckley et al. | 57/124 |
| 1,495,636 | 5/1924 | Feaster | 57/124 |
| 2,563,187 | 8/1951 | Pennati | 57/124 |
| 2,725,712 | 12/1955 | Rooney | 57/124 |
| 3,056,250 | 10/1962 | Backus | 57/119 |
| 4,114,359 | 9/1978 | Creus | 57/124 |

*Primary Examiner*—John Petrakes

*Attorney, Agent, or Firm*—Robert A. Armitage

[57] ABSTRACT

In a ring-type spinning or twisting frame in which the ring stator and the rotor are coupled to one another with rolling members inserted therebetween in grooves formed facing each other in the rotor and the stator, braking means being provided between the stator and the rotor, the improvement is disclosed according to which an annular bracket is provided beneath the annular cage, the seats for the rolling members having appropriately sloping edges, so that when the spinning frame starts its rotation, the annular cage is lifted, whereas the contrary occurs when the spindles are stopped, so that the cage is allowed to fall due to its own weight and the rotor is stopped instantaneously.

7 Claims, 6 Drawing Figures

SPINNING AND TWISTING MECHANISM

The present applicant has already suggested a device for spinning and twisting, intended for being applied to the ring-carrying carriage of spinning frames or continuous twisting frame as a replacement for the conventional devices which consist of a ring and a traveller sliding thereon.

This prior device comprises an annular stator body, an annular rotor body rotatably coupled to said stator, coaxial therewith and with the relevant spindle of the machine and by a rider member hooked to the rotor body, shaped in such a way that a part of the rider member slides over a surface of the stator body whereas another portion of the rider, away from the sliding portion of same, is so shaped as to permit that the yarn being processed is allowed to run therethrough.

The rotatable coupling of the rotor body to the stator body is obtained by inserting rolling members therebetween.

More particularly, according to a preferred embodiment, both the stator and the rotor are equipped with mounted annular throats facing each other within which there are mounted rolling members with spheres which are kept at an appropriate spaced distance from each other in the circumferential direction by the agency of an annular cage.

The braking means provided according to said previous suggestion, exerts, during the operation of the device, that is during the rotation of the rotor body, a certain pressure onto the stator body in order to obtain that, during operation, the rotor driven to rotation by the thread may always remain slightly arrears relative to the spindle so as to enable the thread to be wound onto the tube slipped on such spindle.

It has now been experienced that, at the stopping of the machine for doffing, or for reasons of electric power faults, it may occur that the spindles are stopped, while, conversely, the rotors of the devices continue, by inertial force, to be rotated for a certain time and, in any case, they are stopped with a time lag relative to the spindles. This fact is conducive to the unwinding of a certain thread length of the thread wound onto the tubes slipped on the spindles. This thread length unwound out of the tubes, because of its twist, might become curled around the rotors of the devices, so that thread breakage may occur as the machine is subsequently restarted.

The main object of the present invention is thus to overcome this defect and so to provide that the spinning or twisting devices have their rotors stopped virtually simultaneously with the stoppage of the spindle as the machine movement is arrested.

In order that such an object may be achieved, it has been envisaged to provide, between the stator body and the rotor body, braking means which are inoperative during the normal operation of the spinning or twisting device, but which enter action at the instant of time at which the spindles are stopped. As additional braking means there are used, according to the present invention, the annular cage of the rolling members is inserted between the rotor body and the stator body in combination with a bracket integral with the stator body.

Thus, the device according to the present invention comprises an annular stator body, an annular rotor body rotatably coupled to the stator, rolling members being inserted therebetween which are mounted within throats formed through the stator body and the rotor body, said rolling members being retained circumferentially spaced apart from each other by the agency of an annular cage, and braking means inserted between the stator body and the rotor body, the device being characterized in that the stator body has, beneath the annular cage, an annular bracket which provides a sliding plane, and in that the rolling members are inserted loosely in the respective seats of said annular cage, each of such seats having, in the direction of motion of the cage a front side-edge at least a top portion of which is sloping in a direction which is opposite to said direction of motion, and beneath said sloping portion, an abutment land, the distance between the center of the throats which receive the rolling members, and the plane of sliding of such annular bracket being longer than the distance between the bottom end of said sloping top portion and the botton edge of the annular cage, and shorter than the distance between the top end of said sloping top portion and the lower edge of the annular cage.

The abutment land provided in each seat of the cage can consist of a bottom portion of the front side-edge, said bottom portion having a slope opposite to that of the top portion, but said abutment land can also be formed by the bottom edge of the seat.

Each seat of the cage can have a closed outline, but with advantage, each seat may have at its top an opening so as to facilitate placing the rolling member in position.

By virtue of the improvements provided by the present invention, the annular cage, during the rotation of the rotor body, is so arranged that the rolling members contact the abutment lands of the respective seats, and in such a position, the cage is lifted over the plane on which the bracket integral with the stator body is entrained.

When, conversely, the rotor body is no longer driven to rotation, the annular cage can be depressed by its own weight, until its lower edge comes to rest on the plane on which the bracket glides. The resultant friction between the cage and the bracket causes the cage, and the rotor body therewith, to become arrested nearly instantaneously. During the depressional motion of the cage, the sloping top portions of the front-side-edges of the seat glide on the rolling members, the latter being held in positioned throats of the stator and the rotor bodies facing each other.

The seats of the cage can be of various configurations, provided that the above indicated conditions are abided by.

A few practical embodiments of the device according to the invention are described hereinafter in more detail, by way of example, reference being had to the accompanying drawings, wherein.

Figure 3:
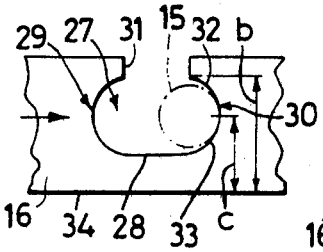
Figure 4:
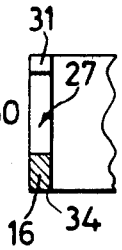
Figure 5:
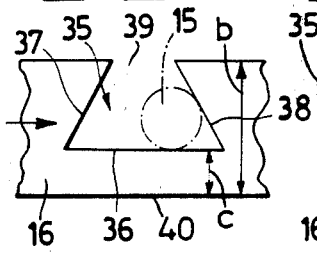
Figure 6:
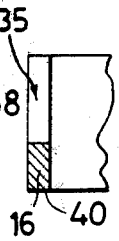

FIGS. 3 and 4 show, in side-elevational and cross-sectional view a detail of one seat of the cage according to a preferred embodiment; and FIGS. 5 and 6 show, in a manner akin to those of FIGS. 3 and 4, another form of the cage seat.

Figure 1:
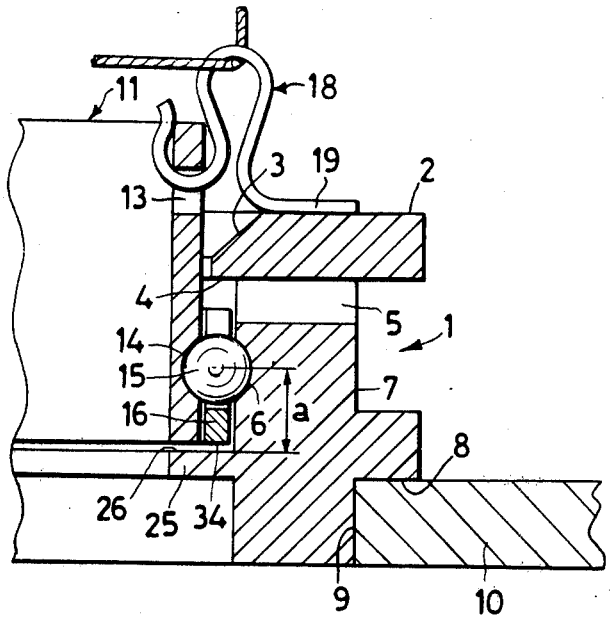
FIG. 1 is an axial vertical cross-sectional view of one half of the device.
Figure 2:
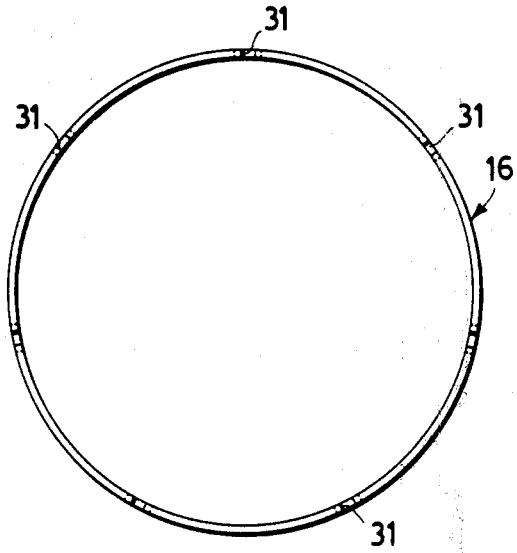
FIG. 2 is a plan view of the annular cage.

Having now reference, at the outset, to FIG. 1, the device comprises an annular stator body 1, with a wide top lane 2, in the shape of an annulus, with a bevel 3, a step 4, lubrication pinholes 5 and an annular throat 6, which is adapted to receive spherical rolling members 15.

In the outer portion 7, of the stator 1, there is provided a step 8, for resting and centering, in the bore 9, the carriage 10 of the spinning frame.

In the internal bottom portion, the stator body 1, has a bracket 25 with a top gliding plane 26.

The annular rotor body 11 is slipped coaxially into the stator body 1, just above the annulus 2, and in correspondence with the jutting portion, there is provided a bore 13, in which the rider 18 is hooked; the portion 19 of the rider 13 rests against the annulus 2 of the stator 1.

In addition, the rotor 11 has an annular throat 14, mounted facing relative to the annular throat of the stator 1, to retain the spherical rolling members 15. The spheres, moreover, are held evenly circumferentially and appropriately spaced apart from each other by an annular cage 16, the spheres being introduced into appropriate seats of the cage.

The device as described up to now in this specification, with the exception of the bracket 25 on the stator 1, corresponds to that of the previous suggestion of the present applicant.

The improvement according to the present invention is more particularly concerned with the configuration of the annular cage 16 and its exploitation as a braking means when the drag which drives to rotate the rotor body 11 is absent.

In a preferred embodiment, as shown in FIGS. 3 and 4, the annular cage 16 is so shaped as to provide, for each spherical rolling member 15, a seat, as generally shown at 27, which has an elongated shape in the circumferential direction of the cage. More particularly, the seat as 27 has a planar bottom edge 28 and two half-circular edges 29, 30, whereas it has a top opening 31 which is slightly wider that the diameter of the spheres 15 to facilitate the introduction and installation of the latter. The diameters of the semicircular side edges 29, 30 are slightly larger than the diameters of the spheres 15 which are inserted, thus, loosely in the seat 27.

FIG. 3 shows with an arrow the normal direction of motion of the annular cage 16, and relative to such a direction, the side edge 29 is "arrear," whereas the edge 30 is "frontal." The cage 16 is dragged in rotation, in the direction of the arrow, by the spheres 15 when the rotor body 11, in its turn, dragged in rotation. Under these conditions, each sphere 15 acts upon the front side edge 30 of the respective seat 27 in the cage 16. In FIG. 3, the sphere 15 is indicated in dotted lines in such a condition. The side edge 30 has a top portion 32, which is sloping (in this case with a slope which is gradually variable) in the direction opposite to the direction of motion of the cage, and has also a bottom portion, 33, which is sloping in a direction concurrent with the direction of motion.

It should be noted that the top end of the sloping top portion 32 of the side edge 30 is at a distance from the bottom base or edge 34 of the cage 16 which is equal to the segment indicated at "b" in FIG. 3, whereas the bottom end of said portion 32 (which coincides with the top end of the bottom portion 33) is at a distance from the bottom edge 34 of the cage 16 which is equal to the segment indicated at "c."

In FIG. 1, the symbol "a" connotes the distance of the center of the annular cage of the stator 1 from the top plane 26 of the bracket 25.

Now, it is vital to the purpose of a correct operation of the device of the invention, as will be seen hereinafter, that the following condition be abided by, that is, that the distance "a" must be shorter than the distance "b" and longer than the distance "c."

Actually, should "a" be not longer than "c," the cage 16 would rest constantly on the gliding plane 26 of the bracket 25. Conversely, should "a" be not shorter than "b," the cage 16 would either not be allowed to descend to the plane 26 (in the case of closed seats) or could not be caused to rise during the operation of the device (in the case of open seats).

The operation of the device is as follows.

When the machine is stationary and thus the rotor body 11 has been stopped, the annular cage 16 rests, with its bottom edge 34, on the top plane 26 of the annular bracket 25. This can occur because the seats 27 of the cage rest, in the vicinity of the top end of the top portions 32 of their side edges 30 on the spheres 15 retained in the throats 6 and 14, respectively, of the stator 1 and the rotor 11.

As the machine is started, the spindles are set to motion and by agency of the threads which emerge from the conventional drawing frame, the rotor bodies 1 of the devices are driven to rotation. The rotor body 11, in its turn, drives to rotation the spheres 15 and the annular cage 16.

Since each of the spheres 15 acts under such condition on the top portion 32 of the front side edge 30 of the respective seat 27, said portion 32 being sloping in a direction opposite to the direction of motion of the sphere, forces are originated which not only tend to drive to rotation the cage 16 in the same direction as the direction of rotation of the sphere, but tend also to lift the cage 16, raising the bottom edge 34 of the cage from the gliding plane 26 of the annular bracket 25.

This tendency to lift the cage 16 lasts until the spheres 15 in their respective seats 27 meet an abutment land.

In the case of the embodiment of FIGS. 3 and 4, this abutting land is the bottom portion 33 of the front side edge 30 of the seat 27. As a matter of fact, inasmuch as this bottom portion 33 has a slope which is opposite to that of the drop of the top portion 32, it would tend to cause a depression of the cage 16 due to the thrust of the relative sphere 15.

A condition of dynamic equilibrium is thus originated, that is, the annular cage 16 is so arranged that the spheres 15 are exactly at the centre of the front lateral edges 30 of the respective seats 27. The points of contact between the spheres 15 and the side edges 30 and their centres are arranged on the equatorial diameter.

As the machine is stopped, the spindles are stopped and the rotor bodies 11 of the devices are no longer driven to rotation by the threads. Thus the thrust of the spheres 15 on the front side edges 30 of the respective seats 27 of the cage 16 is no longer active and the cage, due to its own weight, is lowered so that the top portions 32 of the side edges 30 of the seats 27 are slid downwards on the respective spheres.

As the annular cage 16 is lowered, its lower edge 34 contacts the sliding plane of the bracket 25 and the resultant friction causes the nearly instantaneous stoppage of the cage 16 and thus of the rotor body 11 of each device.

From the foregoing disclosure it is apparent that the function of the sloping portions 32 of the edges 30 of the seats 27 is important to the end of causing the lifting motion of the cage, and the function of the abutment lands 33 is likewise important to arrest the lifting motion of the cage.

The same result can be obtained, of course, also with other forms of seats for the spherical rolling members in the annular cage 16.

FIGS. 5 and 6 illustrate an embodiment with seats 35 of a trapezoidal form. More particularly, these seats have, as shown in FIG. 5, a bottom edge 36 and two side edges, a rear edge 37 and a front edge 38, as well as a top opening 39 the width of which is slightly larger than the diameter of the spheres 15. The front side edge 38 is sloping in the direction opposite to the direction of motion of the cage, and in this case, is planar, that is, its slope is constant. At the bottom section, the edge 38 is directly connected along a radius to the bottom edge 36 of the seat, which, in this case, has the function of an abutment land. At the top section, the sloping edge 38 is connected along a radius to the top edge of the cage 16. Also in this case the distances "b" and "c" of the top and bottom ends of the sloping side edge 38 from the sloping 40 of the cage 16 are in the prescribed relationship relative to the distance "a" (FIG. 1) from the centre of the throat 6 from the sliding plane 26 of the bracket 25.

The operation of this embodiment of the device corresponds accurately to that described above for the embodiment of FIGS. 3 and 4.

It is apparent that the seats in the annular cage may have still other shapes, for example diamond-like or another similar outline, without modifying the operability of the device.

I claim:

1. A spinning and twisting device for a ring-supporting carriage of a spinning or twisting frame, comprising an annular cage having at least one direction of rotation around its axis and having seats, an annular stator body, and an annular rotor body rotatably coupled to said stator body, rolling members being inserted therebetween in a pair of throats mounted facing each other and formed through both said stator and said rotor bodies and being retained spaced apart circumferentially from each other by said annular cage, and braking means between said stator body and said rotor body, wherein said stator body has an annular bracket beneath said annular cage providing a sliding plane and said rolling members are loosely inserted in respective ones of said seats of said annular cage, each of said seats having, in the direction of rotation of the cage, a front side edge having a top portion sloping in a direction opposite to the direction of rotation and having an abutment land beneath said sloping portion, said throats having a center of curvature at a distance from the sliding plane of said annular bracket which is larger than the distance between a lower end of said sloping top portion and a bottom edge of said annular cage, and shorter than the distance between a top end of said sloping top portion and a lower edge of said annular cage.

2. A device according to claim 1, wherein each of said seats has an abutment land comprising a bottom portion of a front side edge of said seat, said bottom portion having a slope opposite to that of the top portion.

3. A device according to claim 1, wherein each seat has a shape which is elongate in the circumferential direction of said cage, with a planar bottom edge and two semicircular side edges having a diameter slightly larger than the diameters of said spherical rolling members.

4. A device according to claim 1, wherein each of said seats has an abutment land comprising a bottom edge of said seat.

5. A device according to claim 4, wherein each of said seats has a trapezoidal shape having a longer base comprising the bottom edge of said seat.

6. A device according to claim 1, wherein each of said seats has a closed contour line.

7. A device according to claim 1, wherein each of said seats has a top opening with a width slightly larger than the diameters of said spherical rolling members to facilitate the mounting of said members.

* * * * *

UNITED STATES PATENT OFFICE

CERTIFICATE OF CORRECTION

Patent No. 4,150,531 Dated April 24, 1979

Inventor(s) Angelo MARZOLI

It is certified that error appears in the above-identified patent and that said Letters Patent are hereby corrected as shown below:

Title Page, [73[ Assignee:, should read as follows:

[73] Assignee: F.LLI MARZOLI & C. S.p.A.,
Palazzolo Sull'Oglio (Brescia), Italy

Title Page, Attorney, Agent, or Firm — should read:

KARL W. FLOCKS

Signed and Sealed this

*Twenty-sixth* Day of *February 1980*

[SEAL]

*Attest:*

SIDNEY A. DIAMOND

*Attesting Officer* *Commissioner of Patents and Trademarks*